United States Patent [19]

Adamska-Koperska

[11] Patent Number: 4,503,591

[45] Date of Patent: Mar. 12, 1985

[54] RING FOR STORING ARTICLES OF CLOTHING

[76] Inventor: Joanna Adamska-Koperska, 2720 N. Francisco Ave., Chicago, Ill. 60647

[21] Appl. No.: 497,106

[22] Filed: May 23, 1983

[51] Int. Cl.[3] ..... A44B 9/00

[52] U.S. Cl. ..... 24/161; 24/27; 24/DIG. 29

[58] Field of Search ..... 24/13, 16, 17 R, 17 B, 24/17 AP, 20 R, 27, 150 R, 150 FP, 155 C, 156, 159, 161, 162, DIG. 29, 542, 543, 548, 549; 16/87.2; 40/21 R, 24, 26

[56] References Cited

U.S. PATENT DOCUMENTS

| | | | |
|---|---|---|---|
| 493,377 | 3/1893 | Frisen | 40/24 |
| 638,654 | 12/1899 | Strobel | 40/24 |
| 1,859,817 | 5/1932 | Dodd . | |
| 2,273,368 | 8/1940 | Mumford | 24/161 R X |
| 2,582,093 | 1/1952 | Ayers | 24/27 |
| 2,778,081 | 1/1957 | Nygard | 24/156 R |
| 3,001,259 | 9/1961 | Scheemaeker | 24/156 R |
| 3,170,213 | 2/1965 | Thomas, Jr. . | |
| 3,346,927 | 10/1967 | Tompkins . | |
| 3,475,796 | 11/1969 | Petti | 24/161 R X |
| 3,673,639 | 7/1972 | Driscoll . | |
| 3,688,348 | 9/1972 | Klotz et al. . | |
| 3,774,267 | 11/1973 | Sneider . | |
| 3,972,094 | 8/1976 | Fuller . | |

*Primary Examiner*—William E. Lyddane
*Assistant Examiner*—James R. Brittain, Jr.
*Attorney, Agent, or Firm*—Marvin N. Benn

[57] ABSTRACT

A clothing ring is provided for storing articles of clothing, such as socks, during laundering, so that the articles are not separated during laundering. The ring has a loop with a sharply pointed end for insertion through the articles of clothing, and another end having a locking member. The pointed end of the loop slides into a U-shaped channel in the locking member for locking the two ends together, to thus prevent separation of the articles of clothing. The ring may also be used as a key ring.

1 Claim, 7 Drawing Figures

RING FOR STORING ARTICLES OF CLOTHING

BACKGROUND OF THE INVENTION

The present invention is directed to a locking ring for storing articles of clothing during laundering to prevent the separation of certain articles.

It is often the problem during the laundering of clothes and other washable articles that certain items get lost. It is also difficult and time-consuming to sort out the separate articles after laundering. For example, it often occurs that pairs of socks will become separated and thus difficult to pair up after laundering. Also, often times one of a pair of socks will get lost during the laundering procedure.

SUMMARY OF THE INVENTION

It is, therefore, the primary object of the present invention to provide a storage locking ring for holding articles of clothing during laundering so that certain articles will not become separated or lost.

The clothing ring of the present invention preferably has a circular loop made of stainless steel spring wire, which loop has one end mounting a locking member so that the other end of the loop may be inserted in the locking member to lock the two ends together and prevent escape of the articles stored on the loop. The other end is sharply pointed to allow insertion, or threading, of the end through the articles of clothing to slide the articles along the loop.

The locking member is preferably a spiral clip, while the sharply pointed end is inserted along a U-shaped channel defined by the spiral clip to lock the two ends togeher. The two ends of the ring are locked together by the force supplied by the natural bias of the spring steel wire utilized. Other material besides spring steel may be used, for example, suitable plastic. The ring of the present invention also has uses in other areas. For example, the ring may be used as a key ring, and may also be used to hang clothing articles in a closet, and the like. Any number of articles may be stored on the loop prior to laundering, so that the articles do not separate during the laundering process, and thus provide ease of sorting afterwards.

BRIEF DESCRIPTION OF THE DRAWING

The invention will be more readily understood with reference to the accompanying drawing, wherein.

DETAILED DESCRIPTION OF THE INVENTION

Figure 4:
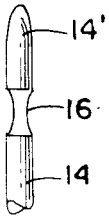
FIG. 4 is a detail top view of the sharp pointed end of the clothing ring of the present invention.
Figure 5:
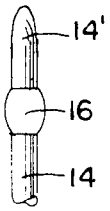
FIG. 5 is a detail side view of the sharp pointed end of the clothing ring of the present invention.
Figure 6:
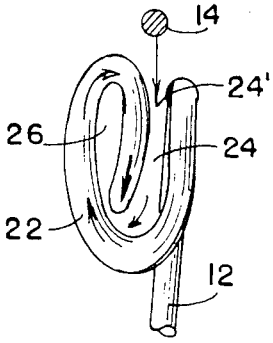
FIG. 6 is a detail side view showing the locking member of the clothing ring of the present invention.

The clothing ring of the present invention is shown in FIGS. 1 through 7, and is indicated generally by reference numeral 10. The ring 10 has a main loop 12 shown formed into a circular cross-section, though other cross-sectional shapes may be employed. The loop 12 is preferably made from stainless steel spring wire, and is provided with one end 14 having a sharp, pointed tip 14' (FIGS. 4 and 5). The sharp, pointed tip allows for easy insertion, or threading, of the end into an article of clothing, such as socks, and the like, for support of the article along the loop 12. Another end 20 of the loop is provided with a locking member 22. Locking member 22, as best shown in FIG. 6, is made of a spiral clip to define a U-shaped channel having a first leg portion 24 and a second leg portion 26. Second leg portion 26 is preferably of smaller width than the first leg portion 24. The first leg portion 24 has an open end 24' through which the first end 14 is inserted. To lock the device, the end 14 is forced downwardly through the first leg portion 24 and then forced into the second leg portion 26, where the natural spring quality of the ring will force the end 14 upwardly until it abuts against the closed end, which is spaced farther from the end 20 than the open end 24', of the second leg portion 26, where it is held, to thus lock the two ends 14 and 20 together and prevent escape of the articles of clothing stored on the loop. To unlock the two ends, the procedure is reversed, with the end 14 being forced downwardly in the leg portion 26 and then allowed to move upwardly through the leg portion 24 and out past the open end 24'.

Figure 7:
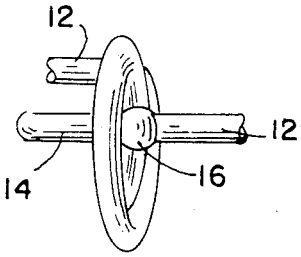
FIG. 7 is a detail view showing the clothing ring in its locked condition.

As shown in FIGS. 4 and 5, the end 14 is provided with a reduced-thickness portion 16, which portion 16 is that portion of the end 14 that travels in the U-shaped channel 24, 26. This reduced-thickness portion 16 allows easy insertion of the end 14 in the locking member, and is also constructed so that it has a greater width than the rest of the end 14, as shown in FIG. 5 and FIG. 7. The increased width allows ease of manipulation of the end 14 for locking and unlocking.

As clearly shown in FIG. 6, the open end 24' has a width slightly less than the largest diameter of the pointed tip 14', which width is approximately equal to the thickness of the reduced-thickness portion 16, so that only the reduced-thickness portion may enter the opening 24' and ride in the U-shaped channel. The second leg portion 26 has a narrow inlet opening that has a width less than the thickness of the reduced-thickness portion 16, as clearly shown in FIG. 6, so that force must be applied to cause the reduced-thickness portion 16 to enter into the second leg portion 26 from the first leg portion 24. This ensures that the reduced-thickness portion and, thus, the end 14, will not become accidentally free from the locking member, as may occur during laundering, or the like. Again, as clearly shown in FIG. 6, the first leg portion 24 starts out narrow in width at the opening 24', and then gradually widens as the leg portion 24 extends. On the other hand, the leg portion 26 starts out narrow in width and then widens toward the closed end of the U-shaped channel. As FIG. 6 clearly shows, the first leg portion 24 is partly hook-shaped or bent, so that the end of the leg portion 24 adjacent the narrow end of the second leg portion 26 bends toward the leg portion 26. This ensures that the reduced-thickness portion 16 will have enough room to enter into the second leg portion 26. The bending of the first leg portion is enough so as to ensure that the width of the reduced-thickness portion 16, as seen in FIG. 5, will be able to clear the space connecting the two leg portions 24 and 26 together, so that the reduced-thickness portion 16 may enter into the leg portion 26 substantially in a plane parallel to the length of the leg portion 26. As clearly shown in FIG. 6, the bend of the first leg portion 24 is toward both the closed end of the second leg portion 26 and toward the second leg portion 26 itself.

Figure 1:
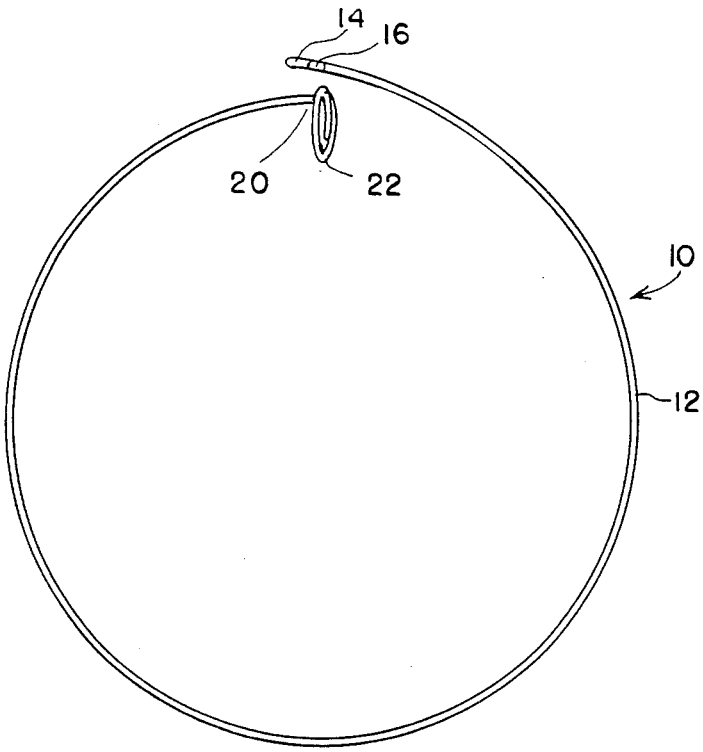
FIG. 1 is a plan view of the clothing ring of the present invention.
Figure 3:
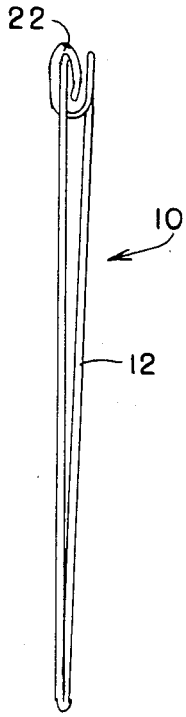
FIG. 3 is a side view of the clothing ring of FIG. 1.
Figure 2:
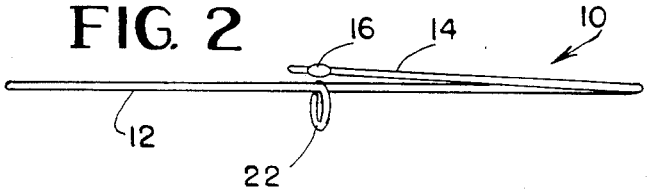
FIG. 2 is a top view of the clothing ring of FIG. 1.

As can be seen in FIGS. 1 and 2, the end 14 is, in its unlocked position, spaced laterally from the end 20 and elevated relative thereto so that when it is moved into the locking member 22, the natural spring bias of the loop will provide the locking force between the ends 14 and 20. The loop 12, the end 14, the end 20, and the locking member 22 are all formed integrally together into one piece. The loop 12 may have a square, rectangular, or oval cross-sectional shape. Other material besides stainless steel spring wire may be employed to form the ring, as long as it is heat resistant to withstand the high temperatures during laundering, and as long as it is free from corrosion, in order to prevent staining the articles of clothing. Suitable plastics may be used. The size of the loop 12 may vary depending upon the end use desired and the holding capacity required. For laundering purposes, where the main articles stored on the ring are socks, and the like, the loop 12 may have a diameter of approximately 4 inches. Greater or lesser sized loops may, of course, be employed. The ring 10 may also be used as a key ring, and other articles may be stored thereon if the need and occasion arise. The ring 10 may also be used to hang articles of clothing in a closet, or the like.

While a specific embodiment of the invention has been shown and described, it is to be understood that numerous changes and modifications may be made herein without departing from the scope and spirit of the invention as set out in the appended claims.

What is claimed is:

1. A ring for holding articles of clothing, and the like, comprising:

a flexible loop portion having a first end and a second end, said first end and said second end being movable toward and away from each other for purposes of locking and unlocking;

a locking member connected to said second end of said loop portion having a passageway in which said first end of said loop portion advances during locking of said first end and said second end together for storing articles of clothing, and the like; said first end of said loop portion being normally spaced from said second end of said loop portion in a lateral direction and elevated above said second end, so that during locking the flexibility of the flexible loop portion provides the necessary locking force to keep said first and second ends locked;

said locking member comprising a flexible clip formed into a spiral shape so that said passageway defines a U-shaped channel along which said first end moves during locking, said U-shaped channel having a first open end directly adjacent to said second end of said loop portion and a second closed end spaced laterally farther from said second end of said loop portion than said first open end, so that, when said first end of said loop portion is forced through said first open end of said U-shaped channel, the natural bias of said loop portion provides a force opposing such movement, and, when said first end of said loop portion is moved along said U-shaped channel until it reaches said second closed end of said U-shaped channel, the natural bias of said loop portion forces said first end of said loop portion against said second closed end of said U-shaped channel, to thereby lock together said first and second ends of said loop portion;

said U-shaped channel comprising a first leg portion having said first open end of said U-shaped channel as its entrance, and a second connecting end; and a second leg portion connected to said second connecting end of said first leg portion remote from said first open end of said U-shaped channel;

said first end of said loop portion comprising a sharp, substantially pointed tip for insertion through articles of clothing, fabric, and the like, for threading the articles onto said loop for storage; said first end of said loop portion further having a reduced-thickness portion which enters into said first open end of said first leg portion of said U-shaped channel and rides along said U-shaped channel substantially along the lengths of said first leg portion and said second leg portion until it reaches said second closed end of said U-shaped channel for locking thereby;

said first open end of said U-shaped channel having a width approximately equal to the thickness of said reduced-thickness portion, so that substantially only said reduced thickness portion may enter therein for locking the first and second ends of said loop portion together;

said second leg portion of said U-shaped channel comprising a first narrow insert end directly adjacent to said second connecting end of said first leg portion, said first narrow insert end having a width slightly less than the thickness of said reduced-thickness portion, whereby force must be applied to urge said reduced-thickness portion past said first narrow insert end; whereby said first end of said loop portion does not become unlocked by the accidental movement of the reduced-thickness portion in the U-shaped channel during laundering, or the like, in reverse manner from that of locking the first and second ends of said loop portion together;

said second leg portion having a second end constituting said second closed end of said U-shaped channel, such that said second closed end lies directly adjacent to said first open end of said U-shaped channel;

said first leg portion having a hook-shaped configuration such that said first leg portion bends toward said first narow insert end of said second leg portion in a direction both toward said second closed end of said U-shaped channel and toward said second leg portion, said second leg portion being substantially linear in extent;

whereby forces acting on the ring during laundering, or the like, that tend to place tensile and bending forces on the first end of the loop portion are prevented from accidentally unlocking the ring by separating the first end from the locking member.

* * * * *